US005345959A

United States Patent [19]

Matteson

[11] Patent Number: 5,345,959

[45] Date of Patent: Sep. 13, 1994

[54] RACK SUPPORT ROLLER FOR DISHWASHING MACHINE AND METHOD OF ASSEMBLY THEREFOR

[75] Inventor: James A. Matteson, Kinston, N.C.

[73] Assignee: White Consolidated Industries, Inc., Cleveland, Ohio

[21] Appl. No.: 91,677

[22] Filed: Jul. 14, 1993

[51] Int. Cl.[5] ..... A47L 15/42

[52] U.S. Cl. ..... 134/201; 312/228.1; 312/334.18; 394/22; 411/399; 411/533

[58] Field of Search ..... 134/201, 56 D, 57 D, 134/58 D; 312/228.1, 334.18, 408, 410; 384/22; 411/399, 533, 970, 999; 211/151

[56] References Cited

U.S. PATENT DOCUMENTS

| | | | |
|---|---|---|---|
| 2,270,813 | 1/1942 | Olson | 411/533 X |
| 3,456,972 | 7/1969 | Drotar | 411/399 X |
| 3,804,483 | 4/1974 | Afful et al. | 312/228 X |
| 3,829,191 | 8/1974 | Jenkins | 312/228.1 |
| 3,851,943 | 12/1974 | Afful | 312/228.1 |
| 4,797,022 | 1/1989 | Crigger | 411/399 X |
| 5,188,495 | 2/1993 | Jones, Jr. | 411/533 X |

*Primary Examiner*—Philip R. Coe

*Attorney, Agent, or Firm*—Pearne, Gordon, McCoy & Granger

[57] ABSTRACT

An article support rack rests on wheels fastened to walls of a washing machine tub. An axle having a partially knurled shaft is inserted through each wheel. A washer is placed over the axle to engage the knurled part and hold the wheel on the axle. The axle is secured in a hole in a wall of the tub.

8 Claims, 3 Drawing Sheets

RACK SUPPORT ROLLER FOR DISHWASHING MACHINE AND METHOD OF ASSEMBLY THEREFOR

BACKGROUND OF THE INVENTION

1. Field of the Invention

This invention relates generally to dishwashing machines and specifically to a novel rack support wheel assembly in a dishwashing machine.

2. Description of the Related Art

Machines used for washing articles, such as dishes, typically include one or more racks to support the articles. The racks comprise a lattice of bent metal rods or molded plastic formed to support the articles while permitting water from jet sprays to contact the articles. To facilitate loading and unloading of articles, the racks are adapted to be at least partially removed from the machine.

In a household dishwasher, for example, the dishes are washed in an enclosure or tub having a front door which pivots downwardly. A lower rack has wheels journalled thereon. The wheels rest on flanges in the tub and permit the lower rack to be rolled out of the tub onto the open door. An upper rack is provided with a track or flange supported by pairs of vertically spaced wheels or rollers mounted on the interior walls of the tub. The upper rack has wheels journalled thereon and resting on or inside the track or flange. Since the rack is movable relative to the track which moves relative to the tub, the telescoping action allows the upper rack to be rolled completely out of the tub while providing complete support on the wheels and tracks which form a cantilever arrangement.

The wheels journalled on the wall of the tub or enclosure are mounted with a screw inserted through a central hole in each wheel. Usually, a washer is placed over the screw. Because the washer and wheel are likely to fall off the screw during assembly, a portion of the screw is deformed to hold the washer in place. Thus, the wheel is secured between the washer and the head of the screw. The screw is then threaded or otherwise secured in the wall of the enclosure.

It has been found that deforming the screw during assembly is time consuming and requires costly tooling. Interruption of the assembly process for the deforming step and for tooling changes is also costly. An assembly of a wheel, axle, and washer can be difficult to manipulate into position for deforming the shaft. Thus, when deforming the shaft, it is possible to inadvertently deform the threads on the shaft thereby adversely affecting installation in the wall. Further, an edge of the shaft which seats against the wall may be inadvertently deformed so that it does not seat well.

Another means of mounting a roller in a washing machine tub is shown in U.S. Pat. No. 3,804,483 to Afful et al. A mounting stud has an outer bearing surface on which the roller rotates and an inner bore for receiving a threaded fastener. The roller is placed on the stud and resilient fingers on an edge of the stud are displaced to hold the roller on the stud. The stud is placed against a wall of the tub and the threaded fastener is secured in the bore through the wall. The stud is a complex component having relatively fragile fingers. In addition, the roller assembly is not complete until it is installed in the tub. That is, there are two pieces which are assembled with the tub wall, one from the inside and one from the outside.

SUMMARY OF THE INVENTION

The present invention provides a method of assembling a washing machine which includes a tub or enclosure and a rack or carrier for holding articles to be washed in the enclosure, said rack being supported by a plurality of wheels to permit the rack to be rolled on the wheels. The method includes the steps of inserting an axle having a head and a partially knurled shaft through a central hole of a wheel; inserting the axle through a central hole of a washer so as to engage an inner edge of the washer hole with the knurled part of the axle and secure the wheel between the head and the washer; and inserting and securing the axle in a hole in a wall of the tub.

Preferably the diameter of the knurled part of the shaft is smaller than an adjacent part of the shaft to form a shoulder or flange spaced from the head which abuts the washer when the axle is inserted through the washer and permits the wheel to rotate freely. The shaft is threaded to be screwed into the wall.

The wheel assembly includes a wheel having a central hole therethrough, a washer having a central hole therethrough, and an axle having a head and a shaft. The shaft extends through the wheel hole and the washer hole and has a knurled part which engages an edge of the washer hole to secure the wheel between the washer and the head. The shaft also has a shoulder or flange spaced from the head, said shoulder abutting the washer to space the washer from the head to permit the wheel to rotate. The diameter of the knurled part of the shaft is smaller than an adjacent part of the shaft to form the shoulder or flange which abuts the washer.

The dishwashing machine includes an enclosure or tub formed of plastic and having walls within which articles can be washed. A wheel assembly as described above is mounted in one of the walls by a means for securing the shaft of the axle in a hole in a wall of the enclosure. An article carrier or rack is located in the enclosure and supported by the wheel so as to permit the carrier to be rolled on the wheel. Preferably a plurality of like wheel assemblies are threaded into walls of the enclosure to support the carrier.

Thus, an efficient dishwasher wheel and method of assembly are disclosed. Production time and cost is reduced, and a more consistent and reliable result is achieved.

DESCRIPTION OF THE PREFERRED EMBODIMENT

Figure 1:
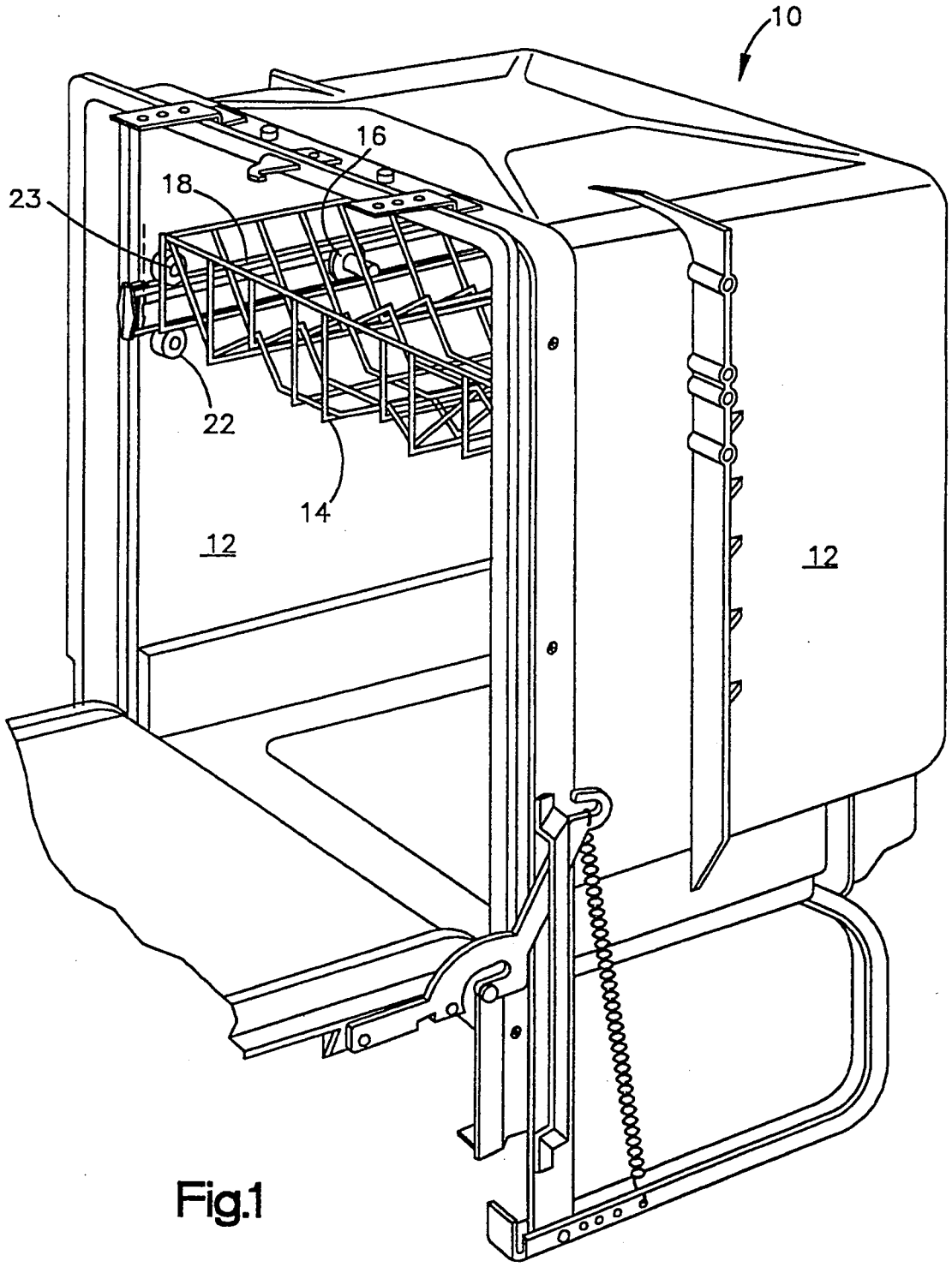
FIG. 1 is a perspective view of a dishwasher with the door open showing the location of the wheel assemblies of this invention.

Referring to FIG. 1, a dishwasher 10 comprises an enclosure or tub having generally planar, vertical side walls 12. As is known, the walls are molded from plastic or formed from a rigid sheet material. At least one article carrier or rack 14 is located within the enclosure to carry dishes and other articles to, be washed. The rack 14 is generally formed from plastic coated metal rods so as to support the articles while permitting wash liquids to be sprayed through the carrier onto the articles.

Figure 3:
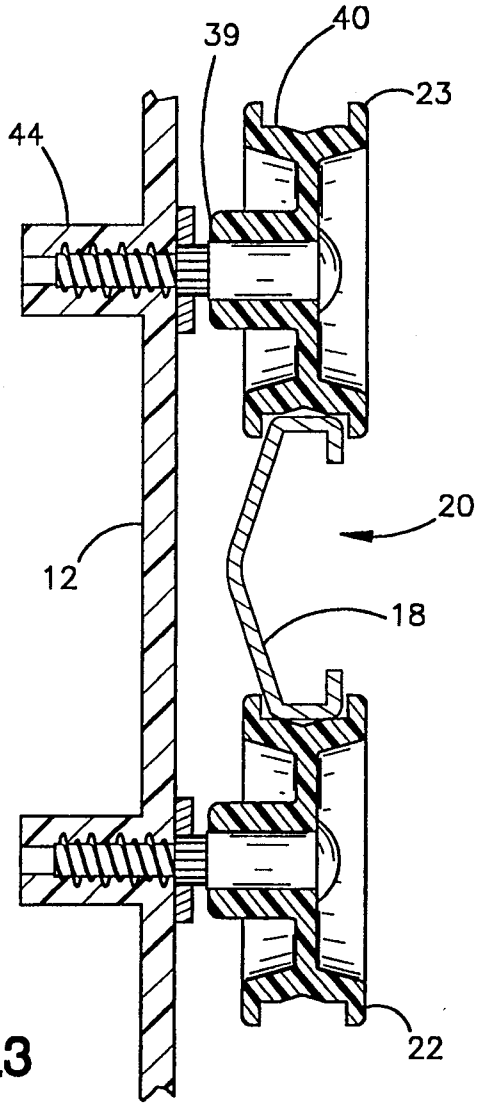
FIG. 3 shows a detailed sectional view of two wheel assemblies supporting a rack slide according to the invention.

Two longitudinally spaced rack wheels 16 or rollers extend outwardly from the rack 14 so as to be supported by a track 18. As shown in FIG. 3, the track 18 forms a channel 20 in which the rack wheels travel. The track 18 is supported between pairs of vertically spaced wheels or rollers 22 and 23 mounted on the side wall 12. Two pairs are provided, with one pair being near the front opening, and the other spaced toward the rear. Mirror image assemblies of wheels 22 and 23, a track 18, and rack wheels 16 are located on the opposite side of the rack 14 and dishwasher 10 as well. The rack 14 is adapted to be pulled from the enclosure such that the rack wheels 16 roll inside the track 18, and the track rolls between the pairs of wheels 22 and 23. The rack 14 is supported between the tracks which are cantilevered from the wheels 22 and 23 in the enclosure. Articles are loaded onto or unloaded from the rack 14, and the rack is pushed into the enclosure such that the rack wheels 16 roll inside the track and the track 18 rolls into the enclosure between the pairs of wheels 22 and 23. To this point, the assembly is well known in the art. The assembly may vary in its details, but is essentially as described.

Figure 2:
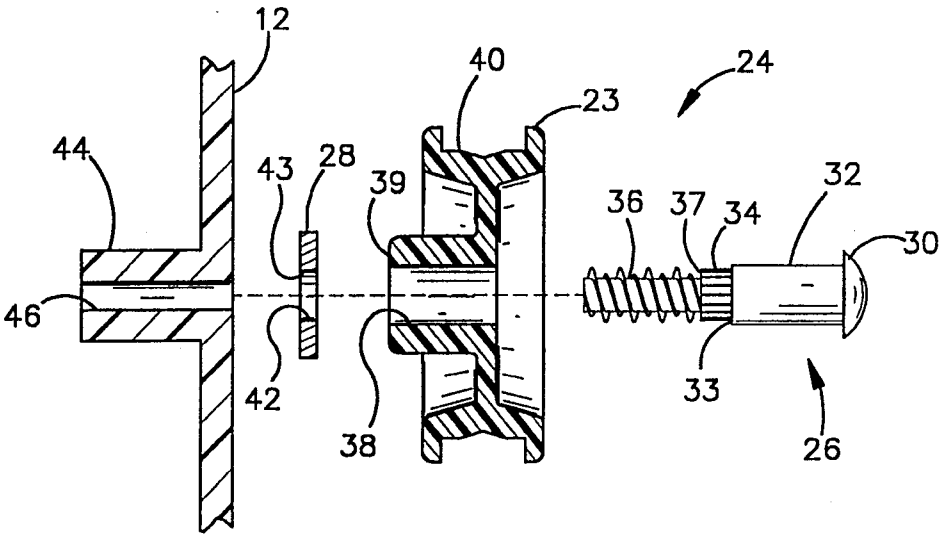
FIG. 2 shows an exploded detailed sectional view of a wheel assembly according to the invention.

Referring to FIG. 2, the wheel 23 is part of a wheel assembly 24 which also includes an axle, such as a shoulder screw 26, and a washer 28. The screw 26 comprises a shaft and a head 30 having a slot or recessed socket for receiving a driving tool. The shaft comprises a first shank part 32 having a relatively smooth, cylindrical surface and second shank part 34 having a lesser diameter than the first shank so as to form a shoulder 33 or flange between the first shank 32 and the second shank 34. The second shank part 34 is knurled, that is, ridges are formed around the circumference of the shank. As shown, the ridges are preferably formed longitudinally, however, circumferential or diagonal ridges may be suitable in some applications. The shaft further comprises a third shank part 36 which is threaded and preferably has a slightly smaller diameter than the knurled second shank part 34 so as to form a second shoulder 37.

The wheel 22 has a central hole 38 through which the screw 26 is inserted. The diameter of the hole should be slightly greater than the diameter of the first shank 32 to permit the wheel to rotate on the screw. The wheel hole 38 and the first shank 32 should have axial dimensions such that the first shank extends slightly beyond an inner face of the wheel 39 when the head 30 abuts the wheel, as shown in FIG. 3. The wheel 22 supports the track 18 in a circumferential channel 40 conforming to an edge of the track, as shown in FIG. 3.

The washer 28 is of a standard type having a central hole 42 and being made of plastic or metal, for example. The washer hole 42 defines an inner edge 43 and should have a diameter less than the diameter of the first shank 32 and approximately equal to the diameter of the knurled second shank 34. The washer is adapted to have the screw 26 inserted through its hole 42 so that the washer 28 abuts the shoulder 33 and is locked in place on the knurled second shank 34.

The tub side wall 12 is provided with a boss 44 and a hole 46 for receiving the threaded third shank 36 of the screw. The threaded shank 36, therefore, is a preferred means of securing the axle in the hole 46. Other means, such as a rivet or a nut on the screw would be suitable.

Figure 4:
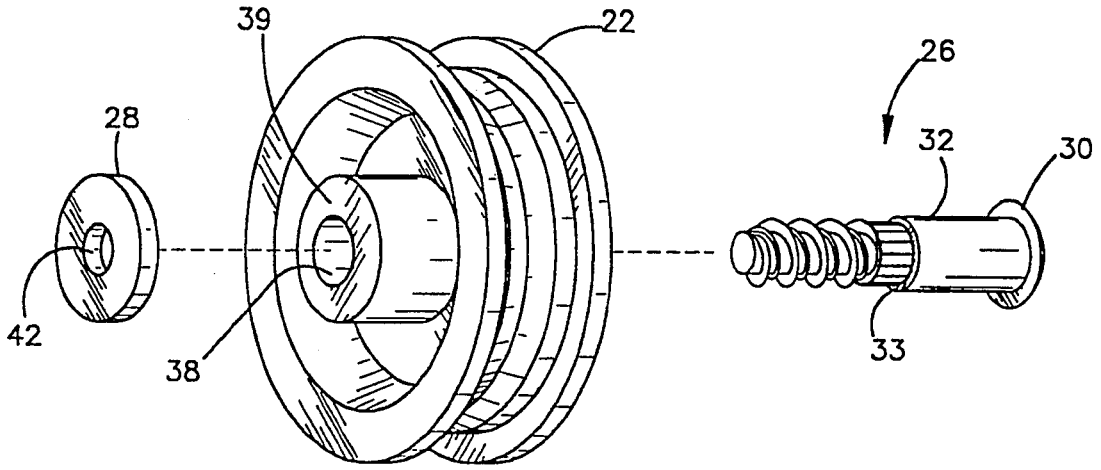
FIG. 4 shows an exploded perspective view of a wheel assembly.
Figure 5:
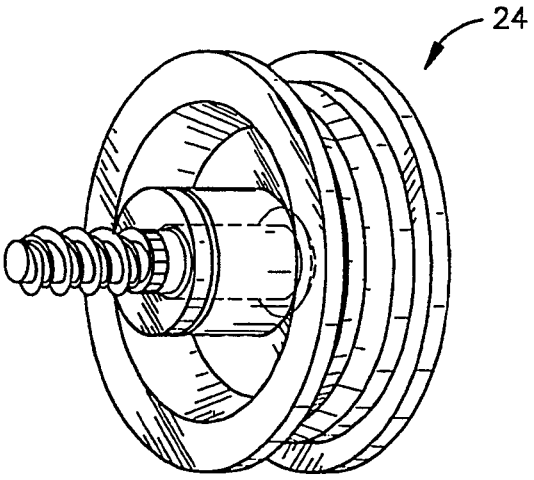
FIG. 5 shows a perspective view of the complete wheel assembly.

Referring to FIGS. 4 and 5, the dishwasher is assembled by inserting the screw 26 through the hole 38 of the wheel 22 so that the head 30 abuts the wheel and the first shank 32 extends slightly beyond the inner face 39 of the wheel to expose the first shoulder 33. Then, the screw is inserted through the hole 42 of the washer so that the washer abuts the shoulder 33 and is frictionally locked onto the knurled second shank part 34. An inner edge of the washer and/or the ridges of the knurled shank part may be deformed slightly by inserting the screw through the washer. The preferred longitudinal ridges permit the washer 28 to be assembled in place without any twisting force which may cause unwanted deformation. The washer 28 is spaced from the head 30 by the shoulder 33, thus, a wheel assembly 24 is formed which permits rotation of the wheel 22 between the washer 28 and screw head 30 on the axle formed by the screw.

Returning to FIGS. 2 and 3, assembly of the dishwasher is completed by inserting and securing the screw in the wall of the enclosure. This is accomplished by driving the threaded shank 36 into the hole 46 of the tub side wall 12 so that the washer 28 and/or the second shoulder 37 abuts the side wall to support the wheel. A plurality of wheels are assembled and installed at appropriate locations in the enclosure, as described above. The tracks 18 and rack 14 are installed so as to be supported by the wheels 22 and 23.

The present disclosure describes several embodiments of the invention, however, the invention is not limited to these embodiments. Other variations are contemplated to be within the spirit and scope of the invention and appended claims.

What is claimed is:

1. A dishwashing machine, comprising:

a tub having walls within which articles can be washed;

a wheel having a central hole;

an axle having a head and a shaft, a part of the shaft being knurled, and the shaft extending through the hole of the wheel;

a washer having a central hole, the shaft extending through the washer hole so as to engage an inner edge of the washer hole with the knurled part of the axle and secure the wheel between the head and the washer;

means to secure the shaft of the axle in a hole in a wall of the tub, the shaft being secured in the hole in the wall; and an article supporting rack located in the tub and supported by the wheel so as to permit the carrier to be rolled on the wheel.

2. A washing machine according to claim 1, wherein the rack is supported by a plurality of wheels.

3. A washing machine according to claim 1, wherein a diameter of the knurled part of the shaft is smaller than an adjacent part of the shaft to form a shoulder which abuts the washer.

4. A washing machine according to claim 3, wherein the shoulder is spaced from the head so as to permit the wheel to rotate freely between the head and the washer.

5. A washing machine according to claim 1, wherein the knurled part of the shaft comprises a shoulder which abuts the wall of the enclosure.

6. A washing machine according to claim 1, wherein the shaft has a threaded part.

7. A washing machine according to claim 6, wherein the axle is threaded into the hole in the wall.

8. A washing machine according to claim 1, wherein the axle is longitudinally knurled.

* * * * *